United States Patent [19]

Hiromoto et al.

[11] Patent Number: 4,676,837

[45] Date of Patent: Jun. 30, 1987

[54] FINISHES FOR FILLING YARNS IN AIR JET LOOM PROCESS

[75] Inventors: Yasuhiko Hiromoto, Toyama; Yoji Mizuhiro, Kashihara, both of Japan

[73] Assignees: Mitsubishi Acetate Kabushiki Kaisha, Tokyo; Matsumoto Yushi-Seiyaku Co., Ltd., Osaka, both of Japan

[21] Appl. No.: 811,365

[22] Filed: Dec. 20, 1985

[30] Foreign Application Priority Data

Dec. 20, 1984 [JP] Japan ..... 59-270044

[51] Int. Cl.[4] ..... C08L 91/06

[52] U.S. Cl. ..... 106/271; 106/177; 252/8.8

[58] Field of Search ..... 106/271, 177; 252/8.8; 558/208

[56] References Cited

U.S. PATENT DOCUMENTS

| | | | |
|---|---|---|---|
| 3,428,713 | 2/1969 | Bartlett | 558/208 |
| 3,549,530 | 12/1970 | Proffitt | 252/8.8 |
| 3,971,733 | 7/1976 | Hawkins | 106/271 |

*Primary Examiner*—Theodore Morris

*Attorney, Agent, or Firm*—Wegner & Bretschneider

[57] ABSTRACT

The present invention relates to finishes for filling yarns suitable for weaving by AJL. It has been found that a combination of paraffins having a specific carbon distribution and viscosity with specific esters and an amine salt of alkyl phosphate gave an excellent flyability without slack and filling entangling even in AJL process.

4 Claims, 5 Drawing Figures

FINISHES FOR FILLING YARNS IN AIR JET LOOM PROCESS

BACKGROUND OF THIS INVENTION

The Air Jet Loom (AJL) is becoming increasingly popular as a progressing loom as well as the Water Jet Loom (WJL) process. AJL has become more popular in recent times because it is more suitable for cellulosic filament yarns such as acetate and rayon which are weakened by water.

Generally, cellulosic filaments for warp yarns are sized before weaving with AJL process. There is not much difficulty compared to conventional looms (shuttle looms) because the process is conducted in dry air as opposed to WJL wherein water is used.

But as for cellulosic filaments for filling yarns, the feeding method is a special one by air jet and the conventionally produced yarns result in poor yield or quality of woven products by their unsuitable property for air jet.

As the air jet is diffusible, it has poor feeding ability comparing to that of a water jet, which is indiffusible. Irregular forms of filling yarns on the line of yarns affects the uneveness of feeding ability, and there exist several problems as follows:

Filling yarns typically do not flow well in air jets and cannot be inserted at required operating speeds.

Filling yarns are tangled by air jet and monofilament is broken.

To solve these problems, flyability is needed for filling yarns in AJL process. The word "flyability" means the easy flowing of yarns in an air jet. High quality yarns for AJL process must meet the need of the flyability. In other words, yarns must be susceptible to being inserted stably under a regular and low air pressure.

The improvement of yarns' flyability is the most important problem in pursuit of good yield in AJL process.

In the conventional methods for finishing, lubricants of mineral oils are typically used as a main component and non-ionic and anionic surfactants are added as emulsifier and antistatic agents. Mineral oils are effective to decrease the friction between fibers and contact surface, i.e. guides, pooling drums, etc. Today, mineral oils having low numbers of carbon atoms and low viscosity at about 5.7 cst. are generally used for this purpose.

But finishes consisting mainly of mineral oils of low viscosity volatilize due to volatilization of residual acetone contained in yarns. Such residual acetone will evaporate during storage of yarns before weaving. This causes the change of the finishes' formulation on yarns or the irregular distribution of finish on yarns between the outer and the inner layers of cheeses which, in turn, results in the irregularity of friction in the weaving process. Thus the serious defects at weaving slack and filling entangling, occur and cause reduced quality of woven fabrics.

SUMMARY OF THE INVENTION

The present invention relates to finishes for filling yarns in Air Jet Loom process (referred to as AJL process hereinafter). An object of the present invention is to provide finishes which give an excellent flyability to filling yarns without slack and entangling.

The finishes of the present invention comprise about 80 to 90% by weight of Component (I), about 5 to 15% weight of Component (II) and about 5 to 10% by weight of Component (III), wherein the Component (I) is a mixture of about 70 to about 50% by weight of paraffin having from 9 to 18 carbon atoms and from about 30 to about 50% by weight of a paraffin having more than 18 carbon atoms. This Component (I) has a viscosity of from 5.7 to 8.7 cst./86° F.;

the Component (II) is an ester of ethoxylated $C_8$–$C_{18}$ alcohol with a $C_8$–$C_{18}$ aliphatic fatty acid; and the Component (III) is an amine salt of $C_8$–$C_{18}$ alkyl phosphate.

DETAILED DESCRIPTION OF THE INVENTION

Figure 1:
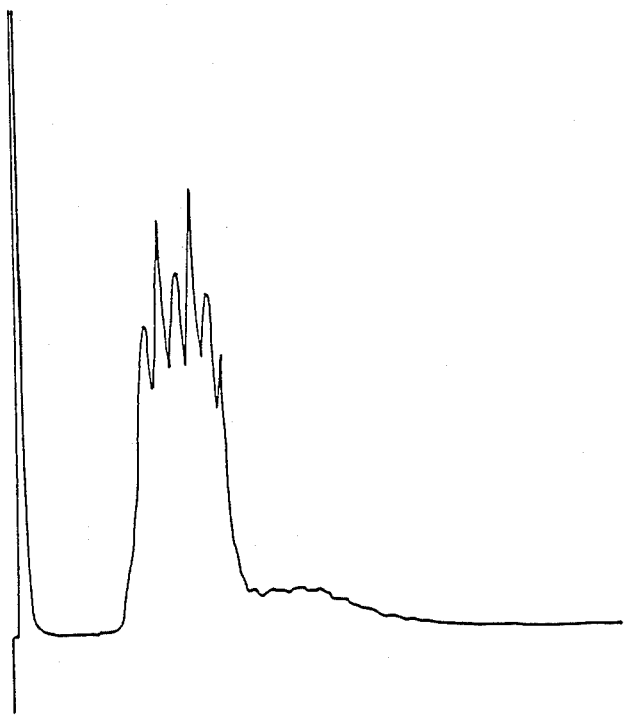
FIGS. 1 to 5 show gas chromatograms on distributions of carbon atoms contained in paraffins used in Examples.

The finish composition of this invention comprises three components, component (I), component (II) and component (III). In the following description, by the term, paraffins or paraffin, is meant saturated aliphatic hydrocarbons.

Component (I) is a mixture of paraffins accounting for from about 80 to about 90 weight percent of the finishes of this invention and consisting essentially of from about 70 to about 50 weight percent of paraffin having from 9 to 18 carbon atoms and from about 30 to about 50 weight percent of paraffin having more than 18 carbon atoms. This Component (I) has viscosity from 5.7 to 8.7 cst/86° F.

Component (II) is an ester which is an ethoxylated alcohol having 8 to 18 carbon atoms in the alkyl group, whose hydroxylic group is esterified with an aliphatic fatty acid which has 8 to 18 carbon atoms. This component accounts for from about 5 to about 15 weight percent of the finishes of this invention.

Component (III) is an alkyl phosphate-amine salt having 8 to 18 carbon atoms in the alkyl group and accounts for from about 5 to about 10 weight percent of the finishes of this invention.

This invention provides finishes for filling yarns in weaving with AJL process and filling yarns finished by this finish.

The paraffins in component (I) which is a main component of the finishes of this invention should be high grade mineral oils containing essentially no aromatic compounds. As precedently described, component (I) is the mixture of paraffins of the said carbon content and viscosity. And the carbon content and the viscosity of those paraffins highly effect on weaving property in AJL process.

Therefore, the preferable mixing ratio of component (I) relating to weaving property in AJL process is about 70 to about 50 weight percent of the paraffin having 9 to 18 carbon atoms and about 30 to about 50 weight percent of the paraffin having more than 18 carbon atoms. The preferable viscosity of the component (I) is from 5.7 to 8.7 cst/86° F.

More preferably, the mixing ratio of component (I) is about 65 to about 55 weight percent of the paraffin having 9 to 18 carbon atoms and about 35 to about 45 weight percent of the paraffin having more than 18 carbon atoms. And the viscosity is from 6.5 to 8.5 cst/86° F.

The relation between the carbon content and the viscosity of the paraffins and the finishing property and the weaving property of the finishes is as follows: The paraffin having 9 to 18 carbon atoms is low in molecular weight and in viscosity, which results in low viscosity of the finishes. And it improves the spreading ability and uniformity of the finishes on fibers' surface and reduces the surface friction. However, it increases the volatility of the finishes. Excess volatility can cause the pick up ratio on yarns to differ between the inner layers and the outside layer of cheeses, which causes variability of surface friction in the following process and results in the poor yield and quality of woven products.

On the other hand, the paraffin having more than 18 carbon atoms volatilizes little, which results in low volatilization of the finishes from fiber's surface. It provides for uniform pick up on yarns' surface wound in the form of cheeses, that is the main factor to improve the processability of the yarns in the following processes.

If the paraffin having 9 to 18 carbon atoms comprises above 70% by weight of the Component (I) or if the Component (I) includes the paraffin having fewer than 9 carbon atoms, the viscosity of the finishes decreases. Though this improves the spreading ability of the finishes on fibers' surface and uniformity in pick up, the volatility of the finishes increases and relatively the weight percent of the paraffin having more than 18 carbon atoms decreases. This causes the practical problem, that is, the poor yield in the weaving process.

On the contrary, if the paraffin having 9 to 18 carbon atoms decreases below 50% by weight, the paraffin having more than 18 carbon atoms increases relatively and it causes the opposit problem, i.e., poor spreading of the finishes on fibers' surface, which results in poor yield in the spinning and the twisting processes.

Considering those aforementioned, the most preferable ratio of Component (I) of the finishes of this invention is from about 80 to about 90% by weight.

Next discussed is the Component (II), the ethoxylated alcohol having 8 to 18 carbon atoms in the alkyl group wherein the hydroxylic group is esterified by an aliphatic fatty acid which has 8 to 18 carbon atoms.

A preferred fatty alcoholic component having 8 to 18 carbon atoms for the finishes of this invention should be or change into liquid when it is reacted with ethylene oxide, a hydrophilic substance, to make an ethoxylated surfactant.

There exist three variants of alcohol useful for this purpose. One of them is a linear alcohol variant such as decyl alcohol or dodecyl alcohol, which has 10 to 12 carbon atoms, for example, Kalcohol-20 (more than 95% has 12 carbon atoms; produced by KAO Corporation) or Conol-20F (mixture of alcohols of 10, 12, 14 and 16 carbon contents; produced by New Japan Chemical Co., Ltd.).

Another possiblity is a mixture of linear alcohols and branched chain alcohols such as isodecyl alcohol, isohexadecyl alcohol and isostearyl alcohol, which have 9 to 18 carbon atoms and the like, for example, Dobanol-23 (carbon content is 12 to 13 and about 80% is linear alcohol; produced by Shell Chemical Co., Ltd.), Dobanol-25 (carbon content is 12 to 15 and about 80% is linear alcohol; produced by Shell Chemical Co., Ltd.), Oxocol-1213 (carbon content is 12 to 13 and about 60% is linear alcohol; produced by Nissan Chemical Industries Ltd.), Diadol-115 (carbon content is 11 to 15 and about 50% is linear alcohol; produced by Mitsubishi Chemical Industries, Ltd.) and Diadol-911 (carbon content is 9 to 11 and about 50% is linear alcohol; produced by Mitsubishi Chemical Industries, Ltd.). These alcohols are produced by Oxo-process.

The remaining variant is the secondary alcohols, for example, Tergitol (carbon content is 11 to 15; produced by Union Carbide Corporation) and Softanol (carbon content is 12 to 14; produced by Japan Catalytic Chemical Industry Co., Ltd.).

It is recognized that ether type non-ionic surfactants obtained from the reaction of ethylene oxide with a fatty alcohol have been used as a component of finishes for cellulose acetate fibers. Typically, in such instances the degree of polymerization of ethylene oxide has been lowered to prevent delustering of fibers by hot water resulting from the finish penetration into fibers. But this is not so effective and has caused other problems such as diminishing the cooling stability or frictional properties of finishes.

To avoid these problems associated with non-ionic type surfactants, the component (II) of the finishes of this invention, i.e., the ethoxylated fatty alcohol which has esterified by aliphatic fatty acid having 8 to 18 carbon atoms, is used.

The degree of ethoxylation, i.e., the molar content of ethylene oxide in Component (II), can be varied. The following ratio of fatty alcohol and ethylene oxide; fatty alcohol/ethylene oxide; 1 mol/3 to 10 mol, is the most preferable. Regarding the aliphatic fatty acid for esterification of the hydroxyl group of ethoxylated fatty alcohol, there are numerous alternative linear or branched, or saturated or unsaturated carboxylic acids which will be known to those skilled in the art, for example, caprylic acid, lauric acid, oleic acid, iso-stearic acid, mixtures of these acids and the like.

Component (II) is most preferably used in an amount of about 5 to about 15 percent by weight based on finish weight considering the scourability and the frictional property of the finishes of this invention.

The component (III) of this invention, an alkyl phosphate amine salt having 8 to 18 carbon atoms in which the alkyl group is discussed below.

The most important requirement relating to use of the cellulose acetate filament's finishes for AJL process in non-aqueous type method is stability of the finishes—especially at low temperature. Therefore, good solubility of the amine salt in the base oil is important.

Antistatic anionic surfactants of the alkyl sulfate type, alkyl sulfonate type, carboxylic acid type and particularly metalic salts of those have been found not suitable in view of such solubility considerations. In accordance with this invention providing a non-aqueous type finishes for cellulose acetate filaments in AJL process, alkyl phosphate amine salt having 8 to 18 carbon atoms in the alkyl group are used.

Fatty alcoholic components used to prepare the phosphate amine salt must be liquid at room temperature. Examples of useful alcohols are octyl alcohol, decyl alcohol, dodecyl alcohol and the like. Mixtures of the linear alcohol and the branched chain alcohol, such as, Dobanol, Oxocol and Diadol which are manufactured by Oxo-process, or secondary alcohols, such as, Tergitol and Softanol, are also suitable. As for amine components, a hydrophobic liquid amine, for example, tributyl amine and dibutylethanolamine, is the most preferable.

On weaving of cellulose acetate filaments with AJL, static electricity is expected to be generated near the pooling drum at 200 to 500 V when the filling yarn is extruded from the pooling drum.

Because the yarn needs to be expanded by static electricity to be easily carried by air jet, the voltage of the generated static electricity must be controlled within a proper range. Too much static electricity causes over-expansion which causes fluff, breakage and entangling of the filling yarn.

For this purpose the amount of above-mentioned alkyl phosphate amine salt which has 8 to 18 carbon atoms in the alkyl group must be controlled properly. The mixing ratio of this alkyl phosphate amine salt should be about 5 to about 10 percent by weight based on the finish weight.

The finishes of this invention are applied to cellulose acetate yarns by any of various means known to and used by those skilled in the art for the application of non-aqueous finishes, including for example, kiss roll, padding, metered finish applicators, and the like.

In producing cellulose acetate filament for the filling yarns in AJL process by applying the finishes of this invention, a pick up ratio 8 1.5 to 2 percent by yarns' weight is sufficient.

Usually cellulose acetate filament yarns are coated with 2 or 3 percent of finishes by yarns' weight for the purpose of improving spinnability when conventional finishes are used. But the finishes of this invention are improved in the uniformity of spreading on fibers' surface and oil pick up can be decreased below 2 percent.

The best applying ratio of the finishes is 1.5 to 1.7 percent by weight based on yarns because it results in fluffs, loops and breakage of yarns at winding into cones.

One positive effect of the finishes of this invention is making yarns capable of being woven under low air pressure.

Generally in AJL process, filling yarns are required to reach the other side of warps after being jetted through the jet nozzle and fed through the air guide or the shed set at the reeds by the sub nozzle. Therefore, the air pressure is set at the proper degree to get the suitable flying speed of yarns. To reduce the air pressure for inserting, the filling yarns must fly fast under low air pressure. Low air pressure has a great effect on decreasing tangle and breakage of yarns and contributes to good yield and high quality of woven products and also improving high speed operations.

Another property of the finishes is making yarns regular on the line of yarns. Filling yarns are usually fed in winding forms of perns, cones or cheeses. There are different degrees of flyability within a given winding form, for example, comparing the outer and the inner layers of cheeses or the top part and bottom part of them. As the air pressure for inserting is uniformly set, the different flyability results in differences in the flying speed of yarns. Low speed causes the stoppage of looms and high speed causes the tangle of yarns and low quality of woven fabrics.

Therefore, the air pressure of feeding nozzle (sub nozzle) may be set at a given value (e.g. 3.5 kg/cm$^2$), and the air pressure of jet nozzle (main nozzle) may be controlled so as to fly the filling yarns from the inner and the outer layers of cheeses or cones at a proper speed. The proper speed is determined according to an air pressure required for inserting the filling yarns from the both layers.

The air pressure of the jet nozzle (main nozzle) is usually set to accommodate the most difficult part of cones to fly the filling yarns, i.e. the outer layers of cones.

However, when the flyability differs much between the outer and the inner layers of cones, yarns from the inner layers fly too fast and it results in the stoppage of the machine or the increase of defects on woven fabrics by tangle of yarns.

The difference of inserting air pressure for filling yarns between the outer and the inner layers of cones should not exceed 0.3 kg/cm$^2$. A difference over 0.5 kg/cm$^2$ does not enable the stable weaving.

The low air pressure of the main nozzle is preferable, because high air pressure often gives friction to the monofilament and causes the breakage which results in the stoppage of looms and defects on woven fabrics.

The difference in flyability is caused by the difference in contained moisture, releasing tension of yarns, deterioration and volatility of the finish. Furthermore, in case of cellulose acetate filament yarns, difference in residual acetone and methylene chloride, the solvent of cellulose acetate dopes, is also regarded as a cause.

This finish is developed to meet the need of improving such irregularity of flyability by controlling moisture-absorptibity, lubricity and volatility.

This invention will now be further illustrated by the following examples.

EXAMPLE I AND COMPARATIVE EXAMPLE I

According to the following conditions taffeta having a width of 122 cm was woven by AJL.:

AJL weaving machine: ZA 100 available from Tsudakoma Co.

Warp: cellulose diacetate filament yarns of Bright (75 deniers/21 filaments, density of fabrics: 100/inch, sized yarns), Revolution: 500 rpm (500 round frequencies of loom a minute), Finishes: shown hereinafter and in Table 1 to 5.

The one revolution means one cycle of weaving. In AJL process, one cycle of weaving basically consists of beating, shedding and inserting, which corresponds to one round of the crankshaft. Therefore each motion can be represented by the angle of crankshaft rounding. And the angle at which inserting is completed is called arrival degree.

In the present Example and Comparative Example the start of beating was set at an angle of 0°, the yarns' starting from main nozzle was set an an angle of 90°, and the arrival degree was controlled at an angle of 225° to 230°.

Results were shown in Tables 1 to 5.

In the tables the inserting air pressure of the outer and the inner layers of cone meant the air pressures of main nozzle determined on the outer layers and the inner layers respectively, which were required in order to gain a proper flying speed in AJL driven at 500 rpm.

In the present Example and Comparative, the air pressure of sub nozzle was set at 3.5 kg/cm$^2$ and that of jet nozzle (main nozzle) was controlled within the range which was suitable to fly the filling yarns released from the outer and inner layers of cone under a proper speed. The following was evaluated excellent that the proper air pressure of jet nozzle was not more than 2 kg/cm$^2$ and the difference between the suitable inserting air pressures between yarns released from the outer layers and the inner layers of cones was not more than 0.3 kg/cm$^2$.

EXAMPLE 1-1

Comparative Example wherein the viscosity of paraffin and the distribution of carbon atoms are improper;

| | |
|---|---|
| **Component I** | |
| Paraffin: Viscosity | 5.5 cst/86° F. |
| Distribution of carbon atoms $C_9$–$C_{18}$/above $C_{18}$ | 75/25 |
| Result analized by gas chromatography is shown on FIG. 1. | |
| **Component II** | |
| Nonionic surfactant: | POE(3) Tergitol lauryl ester (Tergitol mfg. by Union Carbide Corp.) |
| **Component III** | |
| Anionic surfactant: | Dobanol phosphate dibutylethanol amine salt (Dobanol mfg. by Shell Chemical Co.) |

TABLE 1

| | | Comparative Examples | | | | | | |
|---|---|---|---|---|---|---|---|---|
| | | 1-A | 1-B | 1-C | 1-D | 1-E | 1-F | 1-G |
| | | Number of finishes | | | | | | |
| Component | I | 87 | 70 | 80 | 85 | 90 | 80 | 75 |
| | II | 10 | 25 | 15 | 10 | 5 | 10 | 15 |
| | III | 3 | 5 | 5 | 5 | 5 | 10 | 10 |
| Viscosity of the finish (100° F.; cst) | | 5.7 | 7.0 | 6.2 | 6.0 | 5.7 | 7.3 | 7.5 |
| Pick up of the finish (%) | | 1.6 | 1.5 | 1.6 | 1.6 | 1.5 | 1.5 | 1.6 |
| Inserting pressure by air jet ($kg/cm^2$) | the outer layers of cone | 2.0 | 2.3 | 2.2 | 2.1 | 2.0 | 2.4 | 2.4 |
| | the inner layers of cone | 1.3 | 1.7 | 1.4 | 1.4 | 1.3 | 1.6 | 1.7 |
| Difference between the outer and the inner layers ($kg/cm^2$) | | 0.7 | 0.5 | 0.6 | 0.7 | 0.7 | 0.8 | 0.7 |
| Suitability of filling yarn for insertion | | x | x | x | x | x | x | x |

o: Suitable,
x: Unsuitable

EXAMPLE 1-2

Comparative Example wherein the viscosity of paraffin and the distribution of carbon atoms are improper.

Figure 2:
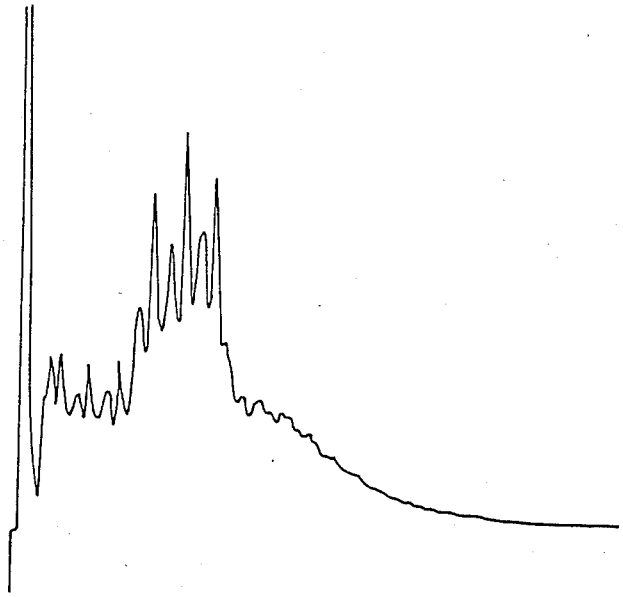

| | |
|---|---|
| **Component I** | |
| Paraffin: Viscosity | 4.4 cst/86° F. |
| Distribution of carbon atoms $C_9$–$C_{18}$/above $C_{18}$ | 20/60/20 |
| Result analized by gas chromatography is shown on FIG. 2. | |
| **Component II** | |
| Nonionic surfactant: | POE(3) Softanol lauryl ester (Softanol mfg. by Japan Catalytic Chemical Industry Co., Ltd.) |
| **Component III** | |
| Anionic surfactant: | Diadol phosphate dibutylethanol amine salt (Diadol mfg. by Mitsubishi Chemical Ind. Ltd.) |

TABLE 2

| | | Comparative Examples | | | | | | |
|---|---|---|---|---|---|---|---|---|
| | | 2-A | 2-B | 2-C | 2-D | 2-E | 2-F | 2-G |
| | | Number of finishes | | | | | | |
| Component | I | 87 | 70 | 80 | 85 | 90 | 80 | 75 |
| | II | 10 | 25 | 15 | 10 | 5 | 10 | 15 |
| | III | 3 | 5 | 5 | 5 | 5 | 10 | 10 |
| Viscosity of the finish (100 ° F.; cst) | | 4.7 | 6.0 | 5.3 | 5.0 | 4.7 | 6.2 | 6.4 |
| Pick up of the finish (%) | | 1.6 | 1.6 | 1.6 | 1.6 | 1.6 | 1.5 | 1.6 |
| Inserting pressure by air jet ($kg/cm^2$) | the outer layers of cone | 2.2 | 2.4 | 2.4 | 2.4 | 2.2 | 2.5 | 2.5 |
| | the inner layers of cone | 1.3 | 1.8 | 1.5 | 1.4 | 1.4 | 1.7 | 1.7 |
| Difference between the outer and the inner layers ($kg/cm^2$) | | 0.9 | 0.6 | 0.9 | 1.0 | 0.8 | 0.8 | 0.8 |
| Suitability of filling yarn for insertion | | x | x | x | x | x | x | x |

o: Suitable,
x: Unsuitable

EXAMPLE 1-3

Example of the spin finishes whose makeup is changed by using the paraffin which has proper distribution of carbon atoms and viscosity.

Figure 3:
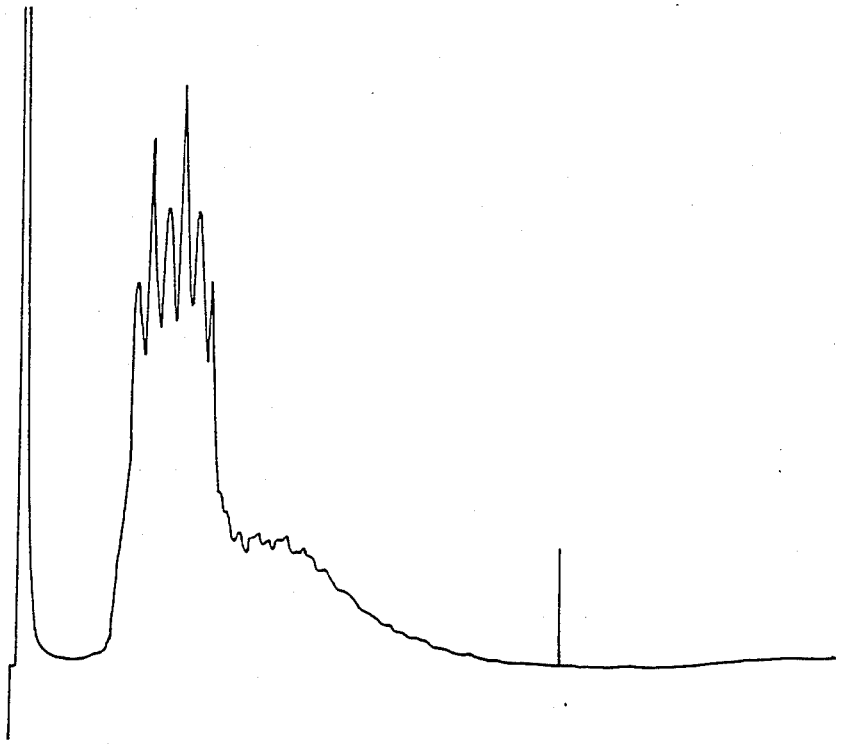

| | |
|---|---|
| **Component I** | |
| Paraffin: Viscosity | 7.6 cst/86° F. |
| Distribution of carbon atoms $C_9$–$C_{18}$/above $C_{18}$ | 60/40 |
| Result analized by gas chromatography is shown on FIG. 3. | |
| **Component II** | |
| Nonionic surfactant: | POE(3) Tergitol lauryl ester |
| **Component III** | |

-continued

| | |
|---|---|
| Anionic surfactant: | Dobanol phosphate di-butylethanol amine salt |

-continued

| |
|---|
| butylethanol amine salt |

TABLE 4

| | | Comparative Exam. | | Example | | | | Comparative Exam. |
|---|---|---|---|---|---|---|---|---|
| | | 4-A | 4-B | 4-C | 4-D | 4-E | 4-F | 4-G |
| | | Number of finishes | | | | | | |
| Component | I | 87 | 70 | 80 | 85 | 90 | 80 | 75 |
| | II | 10 | 25 | 15 | 10 | 5 | 10 | 15 |
| | III | 3 | 5 | 5 | 5 | 5 | 10 | 10 |
| Viscosity of the finish (100° F.; cst) | | 8.2 | 9.6 | 8.8 | 8.9 | 8.5 | 10.0 | 10.1 |
| Pick up of the finish (%) | | 1.6 | 1.5 | 1.5 | 1.6 | 1.5 | 1.6 | 1.5 |
| Inserting pressure by air jet ($kg/cm^2$) | the outer layers of cone | 1.9 | 2.0 | 1.6 | 1.6 | 1.6 | 1.9 | 2.1 |
| | the inner layers of cone | 1.4 | 1.5 | 1.5 | 1.5 | 1.4 | 1.7 | 1.8 |
| Difference between the outer and the inner layers ($kg/cm^2$) | | 0.5 | 0.5 | 0.1 | 0.1 | 0.2 | 0.2 | 0.3 |
| Suitability of filling yarn for insertion | | x | x | o | o | o | o | x |

o: Suitable,
x: Unsuitable

TABLE 3

| | | Comparative Exam. | | Example | | | Comparative Exam. | Example | Comparative Exam. |
|---|---|---|---|---|---|---|---|---|---|
| | | 3-A | 3-B | 3-C | 3-D | 3-E | 3-F | 3-G | 3-H |
| | | Number of finishes | | | | | | | |
| Component | I | 87 | 70 | 80 | 85 | 90 | 92 | 80 | 75 |
| | II | 10 | 25 | 15 | 10 | 5 | 5 | 10 | 15 |
| | III | 3 | 5 | 5 | 5 | 5 | 3 | 10 | 10 |
| Viscosity of the finish (100° F.; cst) | | 7.7 | 9.1 | 8.2 | 8.3 | 8.0 | 7.8 | 9.5 | 9.6 |
| Pick up of the finish (%) | | 1.6 | 1.5 | 1.6 | 1.6 | 1.5 | 1.6 | 1.5 | 1.5 |
| Inserting pressure by air jet ($kg/cm^2$) | the outer layers of cone | 1.8 | 1.9 | 1.6 | 1.6 | 1.5 | 1.8 | 1.9 | 2.2 |
| | the inner layers of cone | 1.4 | 1.5 | 1.4 | 1.4 | 1.4 | 1.3 | 1.7 | 1.7 |
| Difference between the outer and the inner layers ($kg/cm^2$) | | 0.4 | 0.4 | 0.2 | 0.2 | 0.1 | 0.5 | 0.2 | 0.5 |
| Suitability of filling yarn for insertion | | x | x | o | o | o | x | o | x |

o: Suitable,
x: Unsuitable

EXAMPLE 1-4

Example of the spin finishes whose makeup is changed by using the paraffin which has proper distribution of carbon atoms and viscosity.

Figure 4:
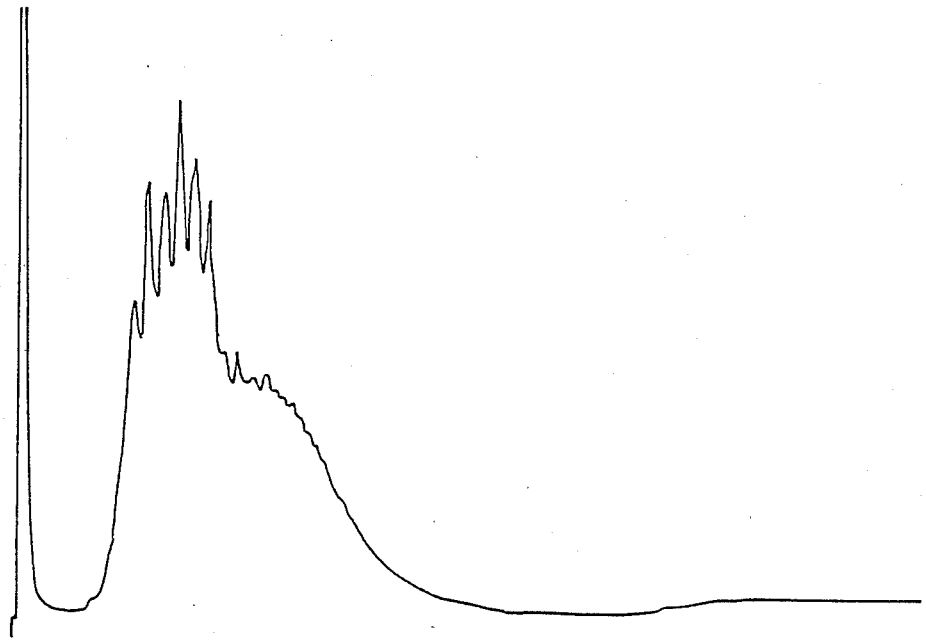

| | |
|---|---|
| **Component I** | |
| Paraffin: Viscosity | 8.0 cst/86° F. |
| Distribution of carbon atoms $C_9$–$C_{18}$/above $C_{18}$ | 50/50 |
| Result analized by gas chromatography is shown on FIG. 4. | |
| **Component II** | |
| Nonionic surfactant: | POE(3) Softanol lauryl ester |
| **Component III** | |
| Anionic surfactant: | Diadol phosphate di- |

EXAMPLE 1-5

Comparative Example of the spin finishes which have high viscosity and improper distribution of carbon atoms.

Figure 5:
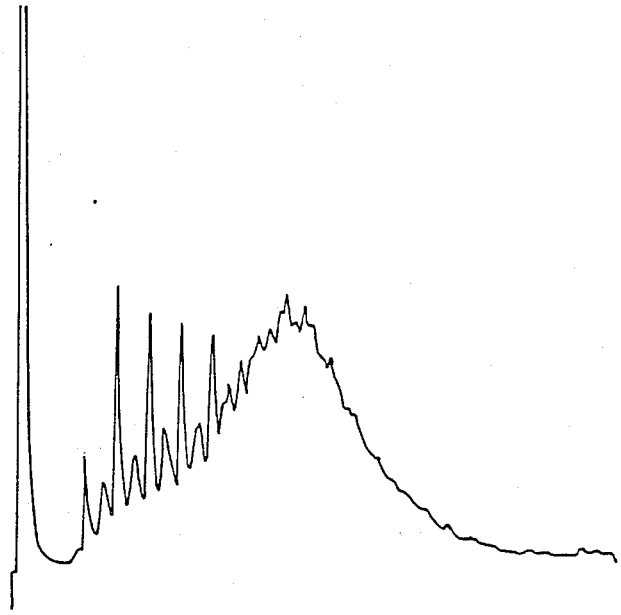

| | |
|---|---|
| **Component I** | |
| Paraffin: Viscosity | 9.5 cst/86° F. |
| Distribution of carbon atoms $C_9$–$C_{18}$/above $C_{18}$ | 40/60 |
| Result analized by gas chromatography is shown on FIG. 5. | |
| **Component II** | |
| Nonionic surfactant: | POE(3) Tergitol lauryl ester |
| **Component III** | |
| Anionic surfactant: | Diadol phosphate di-butylethanol amine salt |

TABLE 5

| | | Comparative Examples | | | | | | |
|---|---|---|---|---|---|---|---|---|
| | | 5-A | 5-B | 5-C | 5-D | 5-E | 5-F | 5-G |
| | | Number of finishes | | | | | | |
| Component | I | 87 | 70 | 80 | 85 | 90 | 80 | 75 |

TABLE 5-continued

| | | Comparative Examples | | | | | | |
|---|---|---|---|---|---|---|---|---|
| | | 5-A | 5-B | 5-C | 5-D | 5-E | 5-F | 5-G |
| | | Number of finishes | | | | | | |
| | II | 10 | 25 | 15 | 10 | 5 | 10 | 15 |
| | III | 3 | 5 | 5 | 5 | 5 | 10 | 10 |
| Viscosity of the finish (100° F.; cst) | | 9.7 | 11.2 | 10.3 | 10.4 | 10.0 | 11.6 | 11.8 |
| Pick up of the finish (%) | | 1.5 | 1.5 | 1.6 | 1.6 | 1.5 | 1.4 | 1.5 |
| Inserting pressure by air jet ($kg/cm^2$) | the outer layers of cone | 2.0 | 2.2 | 2.2 | 2.3 | 2.3 | 2.6 | 2.7 |
| | the inner layers of cone | 1.9 | 2.0 | 2.0 | 2.0 | 2.0 | 2.4 | 2.5 |
| Difference between the outer and the inner layers ($kg/cm^2$) | | 0.2 | 0.2 | 0.2 | 0.3 | 0.3 | 0.2 | 0.2 |
| Suitability of filling yarn for insertion | | x | x | x | x | x | x | x |

o: Suitable,
x: Unsuitable

The measuring conditions for gas chromatography for measuring the distribution of carbon atoms contained in paraffins are as follows:

| Conditions for GLC | | |
|---|---|---|
| Column | Length = 1 m | Internal Diameter = 3 mm |
| Packing Silicone OV-17 (0.75%) | | |
| Support Chromo sorb W (80–100 mesh, MANVILLE CO.) | | |
| Column Temp. | 70° C. → 250° C., 10° C./min. | |
| Inj. (Det) Temp. | 300° C. | |
| Detector | Flame Ionization Detector | |
| Carrier Gas | He | |

EXAMPLE 2

This example demonstrates variation in types and amounts of non-ionic surfactants.

The paraffin is the same as the one used in Example 1-3. The evaluation was carried out in the same manner on Example 1 and further the static electricity and the scourability were measured.

The static electricity was measured by KASUGA TYPE Electrometer running the finished sample yarn on the frictioner (Mirror finished chrome pin, 15 mm in diameter). Result is shown on Table 6.

In Table 6, the circular marks represent acceptable amount of static electricity, i.e., from −200 V to −500 V, and the cross marks represent unacceptable amount of static electricity.

The scourability was calculated by subtracting the oil pick up after washing yarns in warm water from the oil pick up before washing.

The finished yarns are washed in this manner. At first, dip the reeling sample yarns of 10 g in the 300 ml of warm water consisting 2 g/l of scouring agent at 45° C. (trade name; SSK-4, produced by MATSUMOTO YUSHI-SEIYAKU CO., LTD., scouring agent for cellulose acetate yarns).

Agitate slowly and keep it in for 10 minutes then take out the yarns and wash them in water for 5 minutes.

In Table 6, the circular marks show the residual finishes below 5 percent which are regarded as good results of scourability and the cross marks show the residual finish over 5 percent which is regarded as bad results.

| | |
|---|---|
| Component I | |
| Paraffin: Viscosity | 7.6 cst/86° F. |
| Distribution of carbon atoms $C_9$–$C_{18}$/above $C_{18}$ | 60/40 |
| Result analized by gas chromatography is shown on FIG. 3. | |
| Component II | |
| Nonionic surfactant: | (1) POE(3) Tergitol lauryl ester or<br>(2) POE(3) Softanol ether |
| Component III | |
| Anionic surfactant: | Dobanol phosphate di-butylethanol amine salt |

TABLE 6

| | | Example | | | Comparative Example | | | |
|---|---|---|---|---|---|---|---|---|
| | | 6-A | 6-B | 6-C | 6-D | 6-E | 6-F | 6-G |
| | | Number of finishes | | | | | | |
| Component | I | 80 | 85 | 90 | 80 | 85 | 90 | 80 |
| | II (1) | 15 | 10 | 5 | | | | |
| | (2) | | | | 15 | 10 | 5 | 10 |
| | III | 5 | 5 | 5 | 5 | 5 | 5 | 10 |
| Viscosity of the finish (100° F.; cst) | | 8.2 | 8.3 | 8.0 | 8.5 | 8.3 | 8.2 | 9.7 |
| Pick up of the finish (%) | | 1.6 | 1.6 | 1.5 | 1.5 | 1.5 | 1.6 | 1.5 |
| Inserting pressure by air jet ($kg/cm^2$) | the outer layers of cone | 1.6 | 1.6 | 1.5 | 1.8 | 1.6 | 1.6 | 1.9 |
| | the inner layers of cone | 1.4 | 1.4 | 1.4 | 1.5 | 1.5 | 1.5 | 1.7 |
| Difference between the outer and the inner layers ($kg/cm^2$) | | 0.2 | 0.2 | 0.1 | 0.3 | 0.1 | 0.1 | 0.2 |
| Suitability for insertion | | o | o | o | o | o | o | o |
| Static electricity | | o | o | o | o | o | o | x |

TABLE 6-continued

| | Example | | | Comparative Example | | | |
|---|---|---|---|---|---|---|---|
| | 6-A | 6-B | 6-C | 6-D | 6-E | 6-F | 6-G |
| | Number of finishes | | | | | | |
| Scourability | o | o | o | x | x | x | x |

o: acceptable,
x: Unacceptable

EXAMPLE 3

Twenty-seven (27) variants of finishes among the finishes in Examples 1-1 through 1-5 are selected and applied individually to cellulose acetate filament which is spun into acetate filament dull yarns of 75 deniers/21 filaments and wound up into cones of 3 kg by yarns' weight. Then the yarns for filling are woven into taffeta in the same manner as Example 1. The air pressure of Main nozzle is always controlled to result in 225°–230° of arrival degree.

Times of stoppage which are caused by warps or filling yarns in weaving operation of taffeta are measured and shown on Table 7 with weaving conditions.

The rate of looms' stoppage is described by the following manner. The number of looms' stoppage is classified according to the two causes—warps (hairiness or breakage) and filling yarns (tangle or low speed of filling)—and totaled.

Each number is divided by weaving time and the rate is shown by times/loom/hour. For the continuous operation those are preferred to be below 0.2 times/loom/-hour.

Number of defects by filling yarns is the totaled defect relating to the filling yarns—tangle, hairiness and breakage of monofilament—on 50 m of woven taffeta. To maintain the quality of taffeta, the number must be below 5/50 m.

TABLE 7

| | Finish Number | Oil pick up (%) | Pressure of Main nozzle (kg/cm$^2$) | Woven length (m) | Rate of stoppage (times/loom/hour) | Defect by filling yarns | performance |
|---|---|---|---|---|---|---|---|
| Comparative | 3-A | 1.6 | 1.8 | 3000 | 0.55 | above 20 | x |
| Exam. | 3-B | " | 1.9 | " | 0.45 | above 20 | x |
| Example | 3-C | " | 1.6 | " | 0.10 | 2 | o |
| | 3-D | " | 1.6 | " | 0.11 | 0 | o |
| | 3-E | " | 1.5 | " | 0.09 | 0 | o |
| Comparative exam. | 3-F | " | 1.8 | " | 0.33 | 11 | x |
| Example | 3-G | " | 1.9 | " | 0.14 | 3 | o |
| Comparative | 3-H | " | 2.2 | " | 0.52 | above 20 | x |
| Exam. | 4-A | " | 1.9 | " | 0.39 | above 20 | x |
| | 4-B | " | 2.0 | " | 0.34 | 15 | x |
| Example | 4-C | " | 1.6 | " | 0.08 | 0 | o |
| | 4-D | " | 1.6 | " | 0.08 | 1 | o |
| | 4-E | " | 1.6 | " | 0.10 | 2 | o |
| | 4-F | " | 1.9 | " | 0.15 | 0 | o |
| Comparative | 4-G | " | 2.1 | " | 0.62 | 18 | x |
| Exam. | 1-C | " | 2.2 | 500 | 0.51 | above 20 | x |
| | 1-D | " | 2.1 | " | 0.45 | " | x |
| | 1-E | " | 2.0 | " | 0.38 | " | x |
| | 1-F | " | 2.4 | " | 0.50 | " | x |
| | 2-C | " | 2.4 | " | 0.95 | " | x |
| | 2-D | " | 2.4 | " | 1.10 | " | x |
| | 2-E | " | 2.2 | " | 1.00 | " | x |
| | 2-F | " | 2.5 | " | 0.80 | " | x |
| | 5-C | " | 2.2 | " | 0.30 | " | x |
| | 5-D | " | 2.3 | " | 0.25 | " | x |
| | 5-E | " | 2.3 | " | 0.41 | " | x |
| | 5-F | " | 2.6 | " | 0.29 | " | x |

o: acceptable, x: unacceptable

As the preceding examples show, the filling yarns which are coated with the finishes of this invention allow setting the air pressure of Main nozzle at a low level. Finishes of this invention contribute to a decrease in the defects on woven fabrics and the number of looms' stoppage. Furthermore, the finishes allow energy savings in the AJL process.

Thus the finishes of this invention has remarkable effect on improving the quality of woven fabrics and the efficiency in the operation of AJL process.

What is claimed is:

1. A finish for filling yarns in an air jet loom process comprising:

Component (I): from about 80 to about 90 weight percent of a paraffin mixture, said mixture consisting essentially of from about 70 to about 50 weight percent of at least one paraffin having from 9 to 18 carbon atoms and from about 30 to about 50 weight percent of at least one paraffin which has more than 18 carbon atoms, said mixture having a viscosity at 86° F. of from 5.7 to 8.7 centistokes;

Component (II): from about 5 to about 15 weight percent of an ester of an ethoxylated alcohol having 8 to 18 carbon atoms in the alkyl group, the hydroxylic group of said alcohol esterified by an aliphatic fatty acid which has 8 to 18 carbon atoms; and Component (III): from about 5 to about 10 weight percent of an alkyl phosphate amine salt having 8 to 18 carbon atoms in the alkyl group.

2. A finish as claimed in claim 1 wherein the fatty alcoholic component of Component (II) is a branched primary alcohol or a secondary alcohol.

3. A finish as claimed in claim 1 or 2 wherein the fatty alcoholic component of Component (III) is a branched primary alcohol or a secondary alcohol.

4. A finish as claimed in any one of claims 1 to 3 wherein the amine of Component (III) is dibutylethanolamine.

* * * * *